US006480215B1

(12) United States Patent
Mimura et al.

(10) Patent No.: US 6,480,215 B1
(45) Date of Patent: Nov. 12, 2002

(54) CONTROL DEVICE FOR THERMAL PRINTER HEAD AND PRINTER USING THE SAME

(75) Inventors: Takanobu Mimura; Toshiki Nakamura, both of Ise (JP)

(73) Assignee: Shinko Electric Co., Ltd., Tokyo (JP)

( * ) Notice: Subject to any disclaimer, the term of this patent is extended or adjusted under 35 U.S.C. 154(b) by 106 days.

(21) Appl. No.: 09/639,379

(22) Filed: Aug. 15, 2000

(30) Foreign Application Priority Data

Aug. 18, 1999 (JP) ..... 11-232025

(51) Int. Cl.[7] ..... B41J 2/355
(52) U.S. Cl. ..... 347/183
(58) Field of Search ..... 347/9, 10, 15, 347/12, 183

(56) References Cited

U.S. PATENT DOCUMENTS 6,257,685 B1 * 7/2001 Ishikawa ..... 347/10
6,296,341 B1 * 10/2001 Sugahara ..... 347/19

FOREIGN PATENT DOCUMENTS

JP 0819770 A 8/1996

* cited by examiner

*Primary Examiner*—Craig Hallacher
(74) *Attorney, Agent, or Firm*—Scully, Scott, Murphy & Presser

(57) ABSTRACT

A control device for thermal printing head and a printer having the thermal printing head are presented. The control device had a plurality of heating elements to correspond to a plurality of imprinting dots and a plurality of 1-bit registers for holding bit signals to drive each heating element, and includes dividing means for dividing gradation data of a multi-level gradation to express tones of imprinted dots into a plurality of weighted values according to gradation values; and pulse signal generation means for generating pulses having predetermined pulse widths according to respective weighting of gradation values and generating a number of pulses or pulse widths in accordance with a plurality of values of divided gradation data.

9 Claims, 7 Drawing Sheets

CONTROL DEVICE FOR THERMAL PRINTER HEAD AND PRINTER USING THE SAME

BACKGROUND OF THE INVENTION

1. Field of the Invention

The present invention relates to a device for controlling a thermal printing head to produce multiple levels of gradation in each dot, and relates also to a printing apparatus using the thermal printing head.

This application is based on a patent application No. Hei 11-232025 filed in Japan, the content of which is incorporated herein by reference.

2. Description of the Related Art

In printers using a thermal printing head, because each dot is responsible for creating its own shading tone, each heating element is controlled so as to vary the duration of application of heat to each heating element so that each dot can produce a required degree of tone in a printed image (or printed letter). Methods for controlling conventional thermal printing heads to produce multi-level gradation are based on one of the two control methods outlined below.

(1) Method Based on Switching Head Data as Many Times as the Gradation Levels

This method is based on the use of a thermal printing head (referred to as thermal head hereinbelow) in which each dot is given its own register containing one bit. Heat-on or heat-off instruction ("0" or "1") is sent to the thermal head from an external device to control the heating duration for each dot. In this method, if there are 256 levels of gradation, for example, heat on/off instructions must be given at least 256 times or more to each heating element to produce appropriate levels of printed tone.

FIG. 5 shows a block diagram of an example of the circuit to provide a 1-bit register for each dot in the thermal head. In FIG. 5, each heating element corresponds to a dot, so that a thermal head is comprised by heating elements R1~R1920 representing 1920 dots aligned to produce one line of printed dots; 15 integrated control circuits IC1~IC15, each of which controls on/off heating of 128 heating elements; and a thermister for determining the temperature of the thermal head.

As indicated in the block circuit diagram shown in FIG. 6, each of the integrated circuits IC1~IC15 is comprised by: a 128-bit (rows) shift register containing 128 steps of D flip-flop circuits SFF1~SFF128, connected in series, for receiving data from any one of the data signals DATA1~DATA 15; latching circuits comprised by D flip-flop circuits LFF1~LFF128 for holding the output of each row of shift registers SFF1~SFF128; and 128 pieces of NAND gating circuits G1~G128 controlled by strobe signal STROBE; so that each integrated circuit controls application of on/off voltage pulses from an electrical source VH to 128 dots according to the data ("1" or "0") held in the register. The shift register is operated by shift clock signals CLOCK shown in FIG. 5, and an inverted signal produced by inverting the strobe signal STROBE in an inverter INV1 is input in the input terminal of each of the NAND-circuits G1~G128, and an inverted signal produced by inverting the latch signal LATCH in an inverter INV2 is input in the flip-flop circuits FF1~FF128 for timing.

In the method that uses the circuits shown in FIGS. 5, 6 to switch the head data as many times as the number of levels to express the required degree of shading, a data string containing a set of data of 128-dots each, consisting of 128 individual bits to control on/off values of each dot, is input simultaneously (in parallel) from each of the data lines DATA1~DATA15 to the respective integrated circuits IC1~IC15 successively in synchronization with the clock signals. In the integrated circuits IC1~IC15, the data are shifted in the shift registers SFF1~SFF128, and when all the 128-bits are transferred into the shift registers, the bit-data in the shift registers are latched by the latching circuits LFF1~LFF128 when the latch signal is "0". When the strobe signal STROBE turns to "0", latched data in the latching circuits are output from the integrated circuits IC1~IC15 so as to apply the latched data to those thermal heads showing "1". When the strobe signal STROBE turns to "1", all the heating elements are switched off by the Integrated circuits IC1~IC15.

Here, fifteen data signal lines DATA1~DATA15, and output lines for clock signals, latch signal LATCH, strobe signal STROBE, thermister TH1 are connected to the central processor device disposed within the printer (not shown).

A specific example of data transfer will be used to examined the process of data transfer in such a control device. Suppose that there are 1024-levels of gradations to be controlled at a data transfer rate of 14 MHz (frequency of clock signal CLOCK). To control 1024-levels of gradations, it is necessary for each data line to switch on/off data for each heating element in the thermal head 1024-times. The time required for printing one line is determined by the relationship between the time required to carry out 1024 steps of head-data transfer and the printer speed.

Under the conditions noted above, assume for simplicity that a clock cycle operating at 14 MHz is 72 ns (actually 71.4285 . . . ), then one step of head-data transfer requires 72 ns×128 dots=9.216 $\mu$s. To switch head-data 1024-times requires 9.216 $\mu$s×1024=9438 $\mu$s, indicating that it requires 9438 $\mu$s to transfer a set of data for one line. Therefore, even if the printer is capable of printing one line in a minimum time of 2800 $\mu$s, because the data transfer duration (9438 $\mu$s)>one line printing duration (2800 $\mu$s), it can be seen that the printing speed is determined by the speed at which the data are being transferred.

Accordingly, in the method based on successive switching of data dependent on the levels of gradation, it is necessary to transfer to the thermal head as many on/off instructions as there are levels of gradations to be expressed, therefore the printing speed is governed by the speed of transferring head-data to thermal head. To shorten the data transfer interval, the number of parallel signal lines may be increased so as to increase the number of data that can be input in each transfer step, but in such a circuit design, the number of separate input terminal required at the thermal head also increases, leading to an increase in the scale of the control circuit.

(2) Method Based on Functional Head

In this method, control functions are provided on the thermal head so that a register having a plurality of bits and a comparison circuit are provided in the thermal head for each 1-bit-data so that heat on/off can be controlled externally by counter control signals. A general circuit configuration is shown in FIG. 7.

Thermal head shown in FIG. 7 is comprised by 2816-members of heating elements RA1~RA2816; and 44-IC control circuits IC-A0~IC-A43, each of which controls the widths of pulses to be applied to each of the 64-pieces of heating elements according to 8-bit gradation level signals input from data signal lines DATA-0~DATA-7. Data signal lines DATA-0~DATA-7 are connected in parallel to a line joining the IC control circuits IC-A0~IC-A43, and each group of 11-Integrated circuits IC-A0~IC-10, IC-A11~IC-21, IC-A22~IC-32, IC-A33~IC-43 are controlled by respective control signals BE01, BE02, BE03, BE04. Read-data can be input only when the control signals BE01, BE02, BE03, BE04 are at "1".

Each of the IC control circuits IC-A0~IC-A43 is provided with 64-cells of 8-bit registers, counter circuits, comparison circuits and the like so that clock signals are counted, and register selection and generation of comparison values are performed internally within the thermal head. The timing of data input/output operations is controlled by strobe signal STROBE and latch signal LATCH.

In such a method, on/off information for each gradation level of each heating element is transferred through data buses comprised by 8 lines of data signal lines DATA-0~DATA-7, as multiple bit gradation data, to each of the IC control circuits IC-A0~IC-A43. After the first group of control data are output, subsequent groups of control data are output by controlling the on/off information for each heating element according to the gradation levels determined by the gradation control counter provided within each integrated circuit.

According to this method, because the multi-bit gradation level data can be output in parallel, it is possible to shorten the data transfer interval compared with the method based on transmitting on/off information 1-bit at a time serially. However, because it is necessary to provide control circuits having gradation control functions on the head-side, not only the unit cost of Integrated circuits and the size of the control circuit increase but other problems are introduced such as the large size of thermal head and associated high cost.

SUMMARY OF THE INVENTION

It is an object of the present invention to provide a control device for a thermal printing head having one register holding 1-bit for heating each dot so as to produce multi-level gradation printing at a high speed, and to provide a printing apparatus having the control device according to the present invention for a thermal printing head.

The object has been achieved in the present invention in a control device for controlling a thermal printing head having a plurality of heating elements to correspond to a plurality of imprinting dots and a plurality of registers for holding individual 1-bit signals to drive respective heating elements, comprising dividing means for dividing multi-level gradation data expressing shading tones of imprinted dots into a plurality of different weighted values according to gradation values; and pulse signal generation means for generating a plurality of pulse signals having pre-determined pulse widths according to weighting of respective gradation values to be expressed so as to produce a number of pulses or pulse widths in accordance with a plurality of values of divided gradation data.

Accordingly, using a thermal head having 1-bit register for each dot, the present control device enables to produce multi-level gradation printing according to a data transfer process involving lesser number of transfer steps than the number of gradation levels to be expressed. Therefore, the present invention brings a benefit that it is possible to provide highspeed and high fidelity printing of patterns of complex tones using a low cost (commonly available) thermal printing head.

In addition, the object has been achieved in the present invention in a control device for controlling a thermal printing head having a plurality of heating elements to correspond to a plurality of imprinting dots and a plurality of registers for holding individual 1-bit signals to drive respective heating elements, comprising dividing means for dividing multi-level gradation data expressing shading tones of imprinted dots into a plurality of different weighted values according to gradation values; and pulse signal generation means for generating a plurality of pulse signals having pre-determined pulse widths according to weighting of respective gradation values to be expressed so as to produce a number of pulses or pulse widths in accordance with a plurality of values of divided gradation data, wherein pulse-on duration and pulse-off duration for impressing pulse signals during the pre-determined pulse widths are adjusted so that the temperature rise of the thermal printing head for one gradation level will be a constant value.

Accordingly, the pulse-on and pulse-off durations of the impressed pulse in a given pulse width are adjusted so that the temperature rise of the thermal printing head corresponding to one gradation level will be a constant value. By so doing, it is possible to prevent rapid temperature rise or rapid temperature decrease of the printing head. In addition, by controlling the head temperature to rise slowly at a constant rate, beneficial effects are realized such that degradation in the quality of the printed medium, caused by such factors as loss of gloss and feel of roughness of the paper surface brought about by a rapid increase in the head temperature is prevented. Also, if an ink ribbon is being used, it is possible to prevent severing of the ribbon due to heat effects. Also, by selecting the pulse-off duration as described above, excessive cooling of the printing head is prevented, thereby avoiding a situation that the necessary degree of print darkening is not obtained. Further, by preventing the head temperature from rising too rapidly, it is no longer necessary to provide customary thermal history control to counter rapid temperature changes, thereby enabling reductions in the cost and the size of the printer. Accordingly, it is possible to significantly increase the quality of imprinting by choosing the pulse-on duration and pulse-off duration of the pulse impression in a given pulse width such that the temperature rise of the thermal printing head for one gradation level will be a constant value.

DETAILED DESCRIPTION OF THE PREFERRED EMBODIMENTS

The following examples are provided for illustrative purposes only and are not meant to restrict the present invention in any way. Also, to achieve the object of the present invention, it is not always necessary to provide all combinations of the features presented in the examples.

Figure 7:
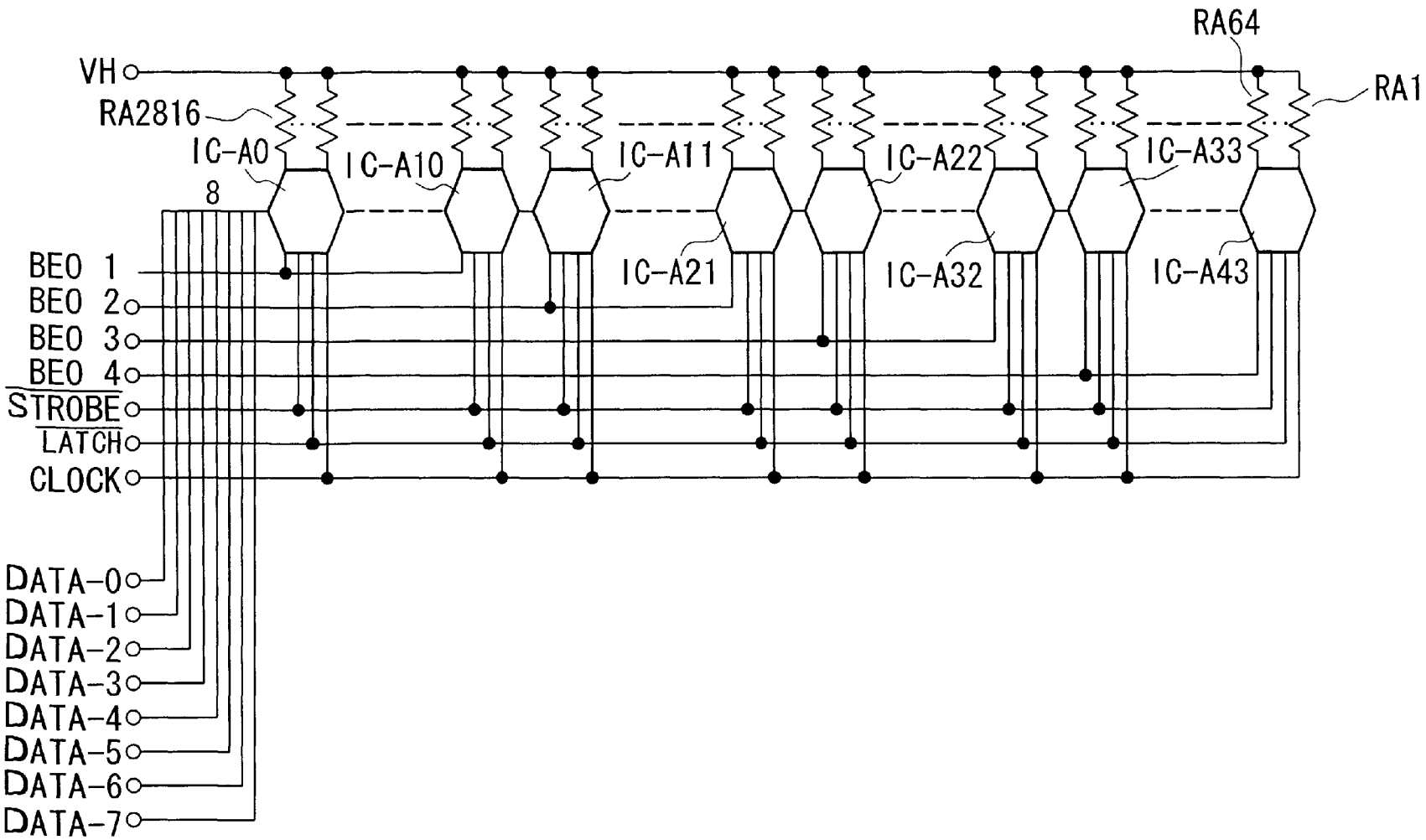
FIG. 7 is a block diagram of an example of a thermal head having a multiple-bit register for each dot in the thermal head.

Preferred embodiments will be explained in the following with reference to the drawings. The present thermal head control device is disposed between a thermal head device of a conventional design and a central processing device for generating gradation data in response to external signals input through an interface device of a conventional printer, and is used to control transfer operation of the gradation data from the central processing device to the thermal head. The thermal head that can be controlled by the present controller corresponds to the one shown in FIG. 5, and has a 1-bit register for each dot, and does not correspond to a thermal head shown in FIG. 7 that has internal integrated circuits for gradation control.

Figure 5:
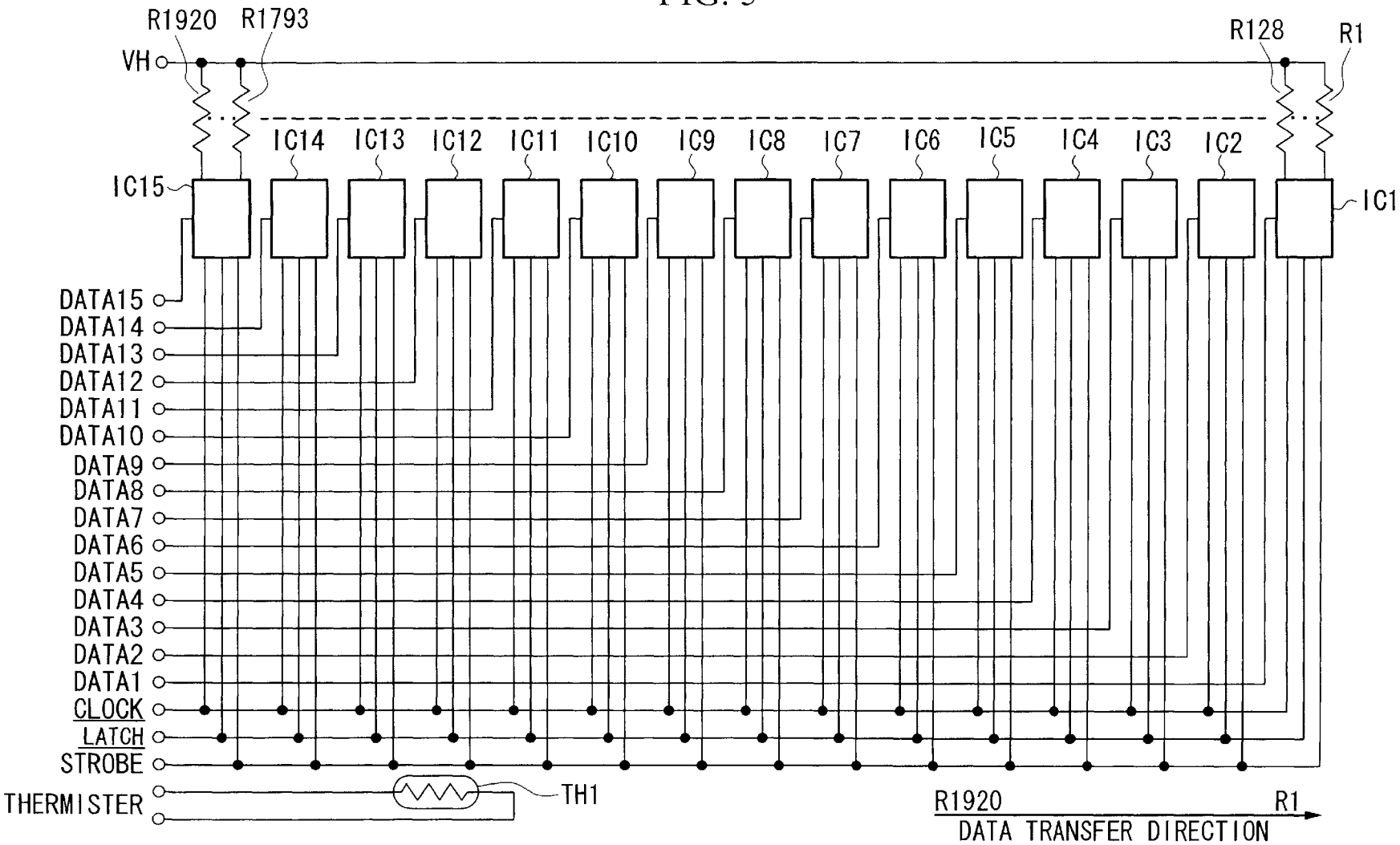
FIG. 5 is a block diagram of an example of the circuit to provide a 1-bit register for each dot in the thermal head.
Figure 6:
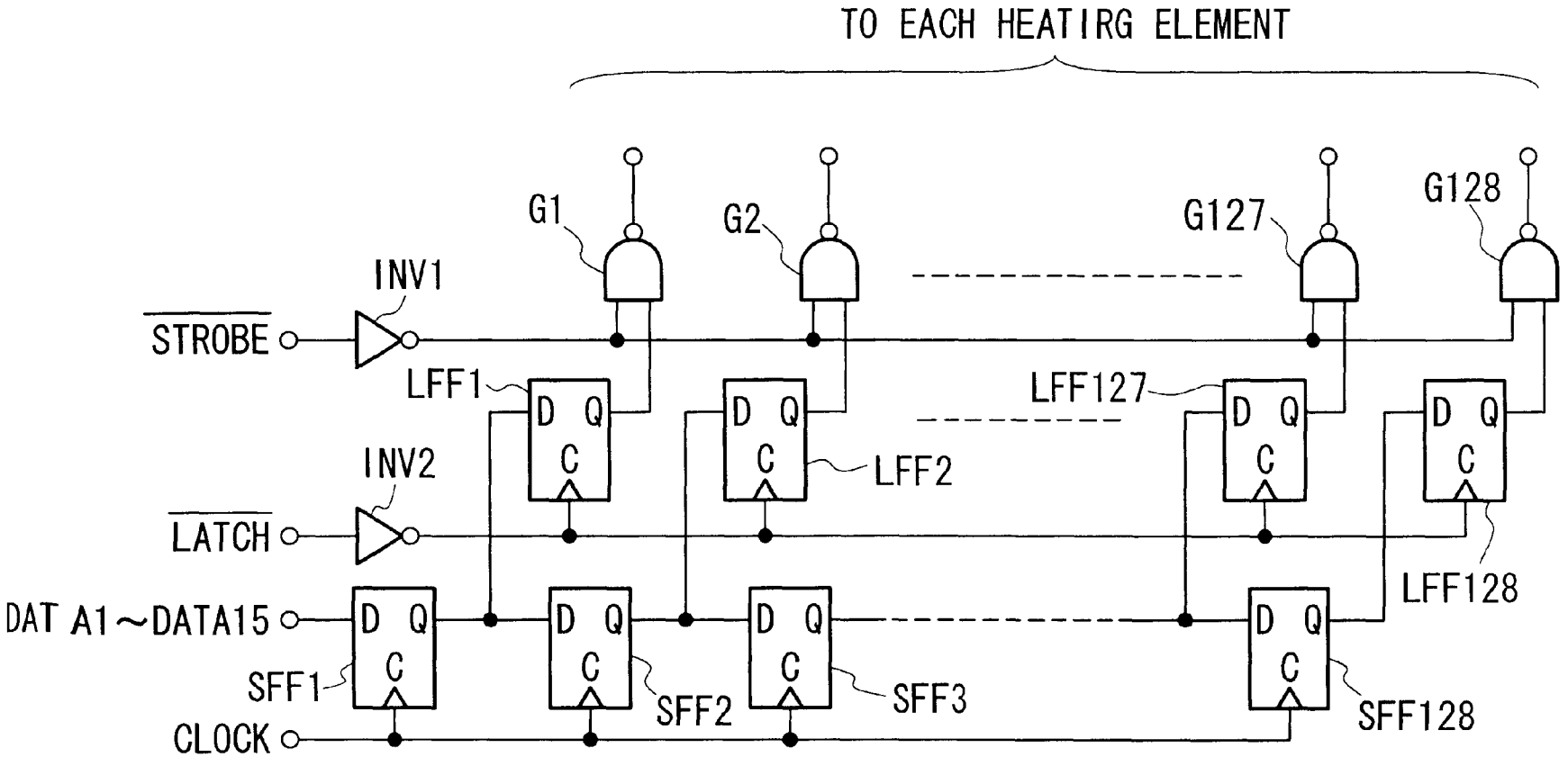
FIG. 6 is a block diagram of the basic circuit configuration for Integrated circuits IC1~IC15.

(1) First, the basic circuit design used to control a thermal head shown in FIG. 5 in this embodiment will be explained. In this case, head-data transfer frequency is 14 MHz, which is governed by the frequency of clock signals CLOCK. Therefore, the maximum number of output data segments that can be processed by the control device is sixteen segments. However, the number of input lines of serial data that can be used in conjunction with the thermal head shown in FIG. 5 is fifteen lines so that one line is not used. It follows that the structure of the shift register inside the thermal head is the same as that shown in FIG. 6, and contains 128-bits. Therefore, one line is provided for each of the control signals, strobe signal STROBE, data latch signal LATCH, and data clock signal CLOCK.

(2) Next, a feature of the method of dividing the gradation levels into N-groups (128 groups in this example will be explained. This method is referred to as the N-division multi-gradation method. Therefore, the gradation levels Dn to be expressed are 1024 levels, which are specified by respective gradation values from 0 to 1023. The gradation level data Dn is divided by 8, which relates to a unit gradation value, and is given by a relation, gradation levels/number of divisions=1024/128=8) to produce two values, a quotient dn and a remainder Da, resulting in a relation, Dn=8×dn+Da.

Figure 1:
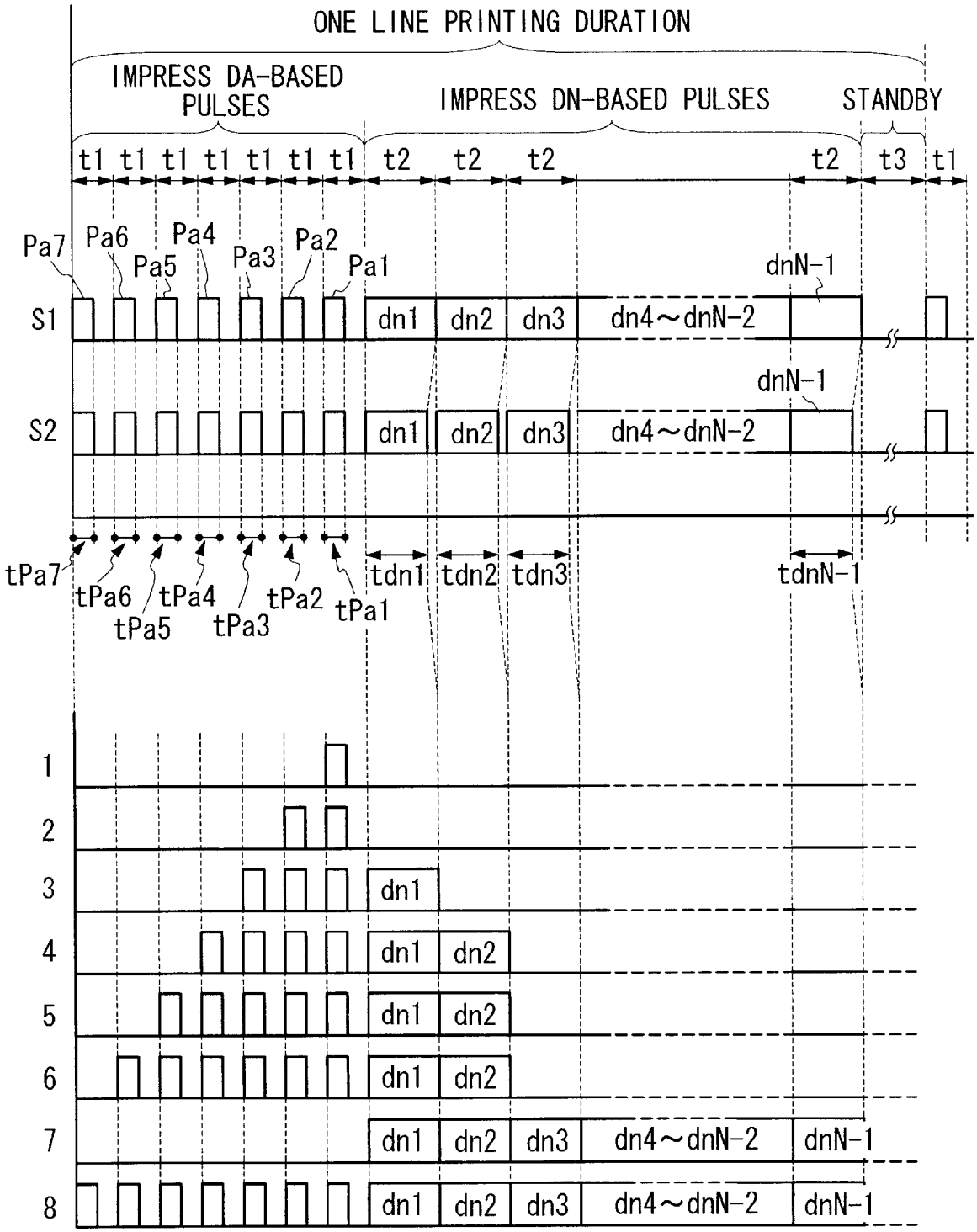
FIG. 1 is a timing chart for the strobe signals STROBE, S1~S2, for the present thermal head shown in FIG. 5, and shows the forms of pulse signal strings impressed on the heating elements.

Strobe pulses serving as strobe signal STROBE to prompt transfer of head data are generated, as shown in FIG. 1, by a central processing device (not shown) or by a combination logic circuits controlled by the central processing device. As shown in FIG. 1, strobe pulse strings are generated in three bands corresponding to three different actions to be taken by the heating element: a first heating cycle containing seven time slots, each time slot having a duration of t1, during which pulses based on the remainder Da are impressed on the heating element; a second heating cycle, containing 127 time slots (127=N−1), each time slot having a duration of t2, during which pulses based on the quotient dn are impressed on the heating element; and a third interval, each time slot having a duration of t3, corresponding to the standby period during which no strobe pulses are generated.

Figure 2:
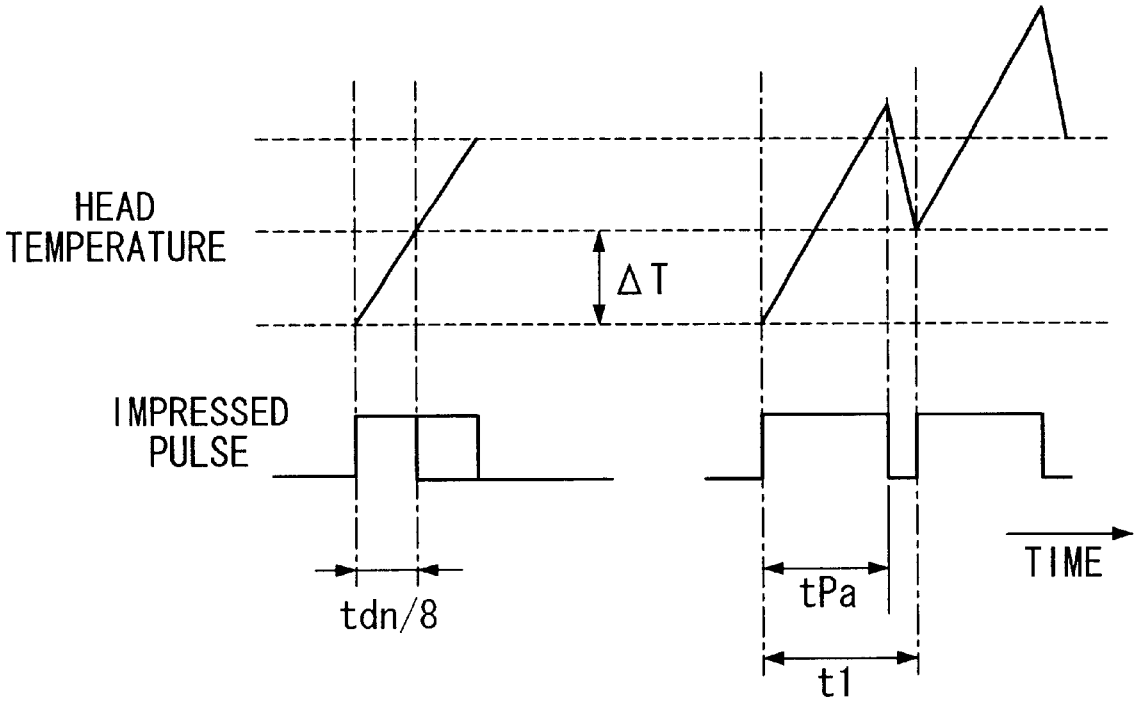
FIG. 2 is a timing chart showing a schematic temperature rise in the thermal head caused by an impressed pulse, and shows how the pulse widths tPa of strobe pulses Pa7~Pa1 are controlled.

The seven strobe pulses Pa7~Pa1, to be applied during the 7 time slots of t1 duration each, are generated so that respective pulse widths are tPa7~tPa1. In this example, it is necessary to select the duration of t1 to be slightly longer than the duration required to forward the 128-bits serial data to the thermal head. Also, in this example, because the ratio of weighting of the gradation values of the remainder to quotient (Da:dn) is 8:1, individual pulse widths tPa7~tPa1 of the respective strobe pulses Pa7~Pa1 applied during the entire interval t1 (including on and off times) must also achieve the same weighting effect. In other words, as illustrated in FIG. 2, the pulse widths tPa7~tPa1 (of the "Da-based" strobe pulses Pa7~Pa1) must be controlled so that an increase in the head temperature produced by heating during the Da-based heating intervals tPa7~tPa1 is the same as the temperature rise ΔT produced by heating during ⅛ of the dn-based heating intervals tdn (relating to the individual pulse widths tdn1~tdnN−1 of the "dn-based" strobe pulses dn1~dnN−1).

On the other hand, in the 127 time slots of the remainder portion, of time interval t2 each, for impressing dn-based heating pulses, pulse widths tdn1~tdnN−1 of the respective pulses dn1~dnN−1 may be the same as the time slot width t2 as shown by the pulse strings S1 in FIG. 1, or may be shorter than the time slot width t2 as shown by the pulse strings S1 in FIG. 1.

The pulse strings (1)~(8) in FIG. 1 show some specific examples of the heating pulses impressed on each heating element. Pulse string (1) relates to a case of producing a gradation value "1" (dn=0, Da=1), and a heating pulse responding to a strobe pulse Pa1 is generated only once during the 7th t1 time slot. Pulse string (2) relates to a case of producing a gradation value "2" (dn=0, Da=2), and heating pulses responding to strobe pulses Pa2, Pa1 are generated twice during the 7th and 6th slots of the t1 time slots. Pulse string (3) relates to a case of producing a gradation value "11" (dn=1, Da=3), and heating pulses responding to strobe pulses Pa3~Pa1 are generated three times during the 5th~7th slots of the t1 time slots and once during the t2 time slot for strobe pulse dn1.

Pulse string (4) relates to a case of producing a gradation value "20" (dn=2, Da=4), and heating pulses responding to strobe pulses Pa4~Pa1 are generated four times during the 4th~7th slots of the t1 time slots and twice during the t2 time slots for strobe pulses dn1~dn2. Pulse string (5) relates to a case of producing a gradation value "21" (dn=2, Da=5), and heating pulses responding to strobe pulses Pa5~Pa1 are generated five times during the 3th~7th slots of the t1 time slots and twice during the t2 time slots for strobe pulses dn1~dn2. Pulse string (6) relates to a case of producing a gradation value "22" (dn=2, Da=6), and heating pulses responding to strobe pulses Pa6~Pa1 are generated six times during the 2th~7th slots of the t1 time slots and twice during the t2 time slots for strobe pulses dn1~dn2.

Pulse string (7) relates to a case of producing a gradation value "1016" (dn=127, Da=0), and heating pulses are not generated during the t1 time slots but all the pulses are generated 127 times during the t2 time slots for strobe pulses dn1~dn127. Pulse string (8) relates to a case of producing a gradation value "1023" (dn=127, Da=7), and heating pulses in response to strobe pulses Pa7~Pa1 are generated seven times, i.e., during all the t1 time slots, and 127 times during the t2 time slots for strobe pulses dn1~dnN−1 (=dn127).

As described above, gradation data are divided into 128 segments in this example, and therefore, it becomes possible to reproduce the 1024-levels of gradation by impressing heat on/off pulses to a maximum of 7 times to correspond to the remainder portion, 127 times for the quotient portion of the gradation data, which is in effect, the number of transfers to send the gradation data to the heating element. In transferring such on/off data for each time slot, 128-bit serial signals in each data line DATA1~15 are processed in groups using preceding time slots.

In this embodiment, because the transfer frequency used to transfer head-data is 14 MHz (giving a cycle time of 71.42857 . . . ns), it is necessary that the time slot t1 be Slightly longer than 71.42857×128 bit=9.14 μs. In this case, if the interval is chosen as 9.2 μs, then other printing parameters may be chosen as follows. For example, if one line printing time is chosen as 2800 μs; pulse width of 128 segments tdn1~tdn127 at 16 μs; and if time slot t2 is made the same as the pulse width of 128 segments tdn1~tdn127, the maximum continuous pulse impression duration is 2032 μs (=16 μs×127), standby duration t3 is about 703 μs (=2800 μs−2032 μs−9.2 μm×7). The pulse widths tPa7~tPa1 of strobe pulses Pa7~Pa1 are chosen so that tdn/8=16 μs/8, as illustrated in FIG. 2.

In the above example, data transfer occurs (127+7) times, and the time required to transfer the data is (127 times×9.14 μs)+(7 times×9.14 μs) giving 1225 μs overall. Therefore, it is possible to transfer all the data within the allotted one-line printing time of 2800 μs.

Also, the strobe pulse widths tPa1, tPa2, tPa3, tPa4, tPa5, tPa6, tPa7, tdn1~tdn127 are made adjustable within a width of 50 ns. By so doing, ghost correction during printing can be carried out in units of any strobe pulse.

Also, as shown in FIG. 2, the pulse-on duration (tPa, tdn in the diagram) and pulse-off duration of impressing the pulse during the pulse widths of different weighting (t1, t2) are chosen in this embodiment so that the head temperature rise for one gradation level will be ΔT.

In other words, the pulse-on and pulse-off durations of the impressed pulse in a given pulse width are adjusted so that the temperature rise of the thermal printing head corresponding to one gradation level will be a constant value. By so doing, it is possible to prevent rapid temperature rise or rapid temperature decrease of the printing head.

In addition, by controlling the head temperature to rise slowly at a constant rate, beneficial effects are realized such that degradation in the quality of the printed medium, caused by such factors as loss of gloss and feel of roughness of the paper surface brought about by a rapid increase in the head temperature is prevented. Also, if an ink ribbon is being used, it is possible to prevent severing of the ribbon due to heat effects.

Also, by selecting the pulse-off duration as described above, excessive cooling of the printing head is prevented, thereby avoiding a situation that the necessary degree of print darkening is not obtained. Further, by preventing the head temperature from rising too rapidly, it is no longer necessary to provide customary thermal history control to counter rapid temperature changes, thereby enabling reductions in the cost and the size of the printer. Accordingly, it is possible to significantly increase the quality of imprinting by choosing the pulse-on duration and pulse-off duration of the pulse impression in a given pulse width such that the temperature rise of the thermal printing head for one gradation level will be a constant value.

Figure 3:
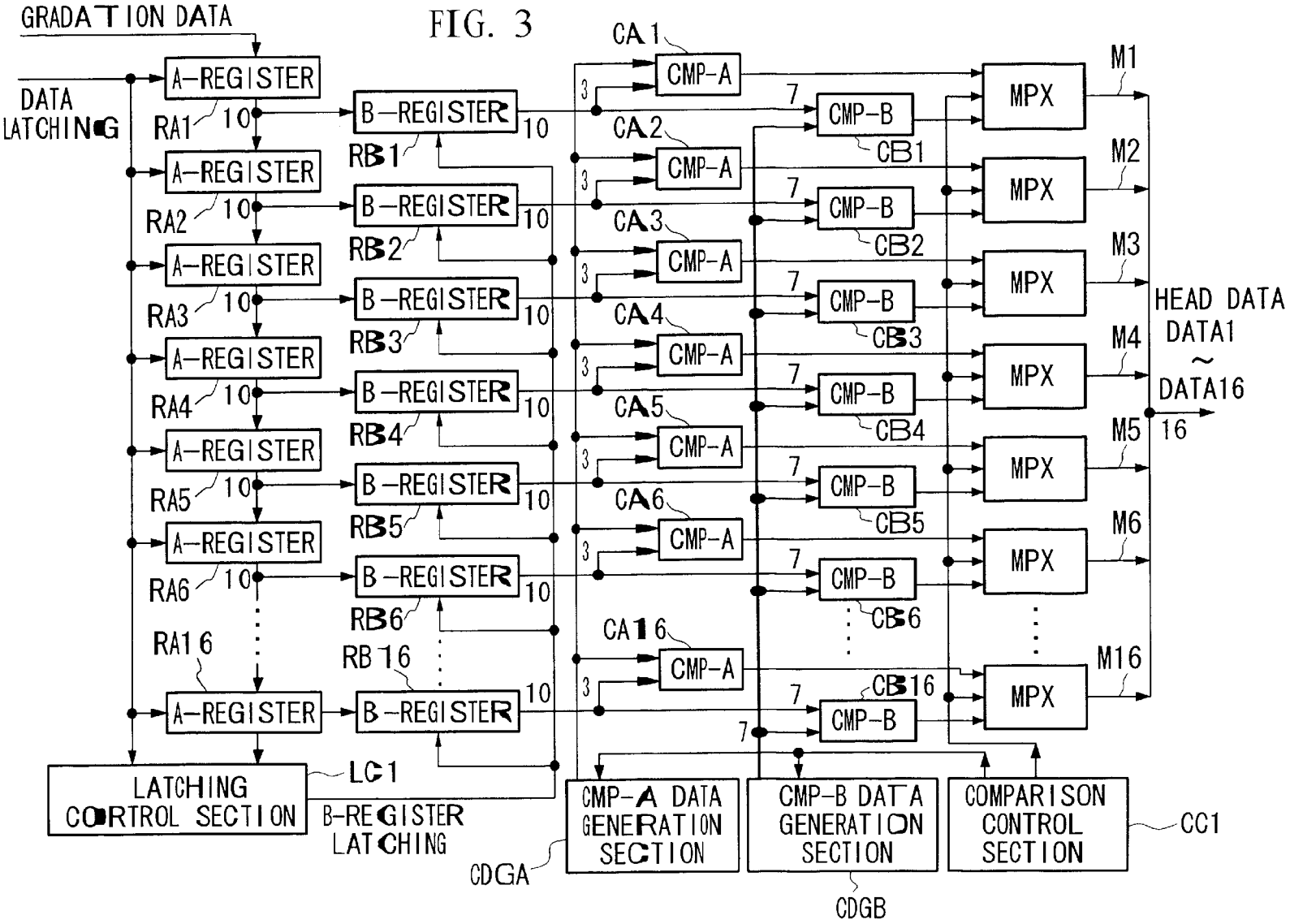
FIG. 3 is a block diagram of an example of the control device for the thermal head.

Next, with reference to FIG. 3, a specific circuit configurations of the control device will be presented to explain the operation of the thermal head according to the method outlined above. FIG. 3 shows a block diagram of the circuit of the thermal head control device for generating head data DATA1~DATA16 (in this example, DATA16 is not used) from the gradation data received from the central processing device. and outputting data to the thermal head shown in FIG. 5.

The gradation data supplied by the central processing device are input into a 10-bit register (A-register) RA1 through a 10-bit data bus. It should be mentioned here that in the following diagrams including FIG. 3, multiple-bit parallel signal lines are shown in bold lines, and the number of bits is shown by placing a number nearby (for example, the ribbon input for register RA1 is indicated by "10"). The gradient data to be input are generated so that the 1920-strings of 10-bit data showing the gradient levels 0~1023 to correspond to 1920-heating elements R1~R1920 are included by duplicating (7 times+127 times) the process for each one line printing cycle. The sequence of forwarding the gradient data is started with the data for heating element R1, followed by the order in each IC1~IC15, i.e., DATA1, DATA2, . . . , DATA15, and starting with the right end heating element R1, R129 (not shown), . . . , R1793 in FIG. 5. When one cycle of data lines DATA1, DATA2, . . . , DATA15 is completed, the process is started over again starting with the heating element R2 (not shown) in IC1 to successively transfer gradient data as describe above.

In the device shown in FIG. 3, because the 16-stage 10-bit shift register is served by a series-connected A-registers RA1~RA16, for every incoming 15 sets of transfer gradient data, A-registers RA1~RA15 hold gradient data to correspond with outgoing data signals DATA15~DATA1. Data latching signal strings are pulse strings for the A-registers RA1~RA16, and are generated by the central processing device in synchronization with each gradient data. These pulses are generated at 14 MHz to coincide with each timing slot, and are comprised by a set of 15 lines of 128-bits, and are generated and stopped intermittently. The latch control section LC1 outputs latching signals so that, for each transfer of a set of 15 lines of gradient data, the data stored in the A-registers RA1~RA15 will be output to B-registers RB1~RB16.

The 10-bit gradient data respectively latched by the B-register RB1~RB16 are input in such a way that the upper 7-bits are entered in the 16-comparator-Bs (CMP-B) CB1~CB16, and are compared with the reference signals input from the comparator B data generation section CDGB, and the remaining lower 3-bits are input in the 16-units of comparator-A (CMP-A) CA1~CA16, and are compared with the reference signals input from the comparator-A data generation section CDGA. Here, the upper 7-bits of the 10-bit gradation data correspond to the values (0~127) of the quotient dn, and the lower 3-bits correspond to the values (0~7) of the remainder Da.

The comparator-A data generation section CDGA generates reference values 7, 6, . . . , 3, 2, 1 so that the values decrease by 1 each time at a timing to correspond with 7-t1 timing slots shown in FIG. 1. The comparator-B data generation section CDGB generates reference values 1, 2, 3, . . . , 126, 127 so that the values increase by 1 each time at a timing to correspond with 127-t2 timing slots shown in FIG. 1. The timing for generating the reference signals for the comparator-A data generation section CDGA and the comparator B data generation section CDGB is controlled according to control signals supplied from the comparison control section CC1.

The comparator-A CA1~CA16 compares the 3-bit data for the Da portion with the reference values supplied by the comparator-A data generation section CDGA, and outputs level "1" signal when the 3-bit data are higher than the reference values, and outputs "0" signal for all other cases, to one selection terminal of each 16-multiplexers M1~M16. The comparator-B CB1~CB16 compares the 7-bit data for the dn portion with the reference values supplied by the comparator-B data generation section CDGB, and outputs level "1" signal when the 3-bit data are higher than the reference values, and outputs "0" signal for all other cases, to other selection terminal of each of the 16-multiplexers M1~M16.

The comparison control section CC1 output selection signals to the multiplexers M1~M16, according to clock signals CLOCK and others, so as to select output from the comparator-A CA1~CA16 at the timing to match the seven slots of t1 time slots shown in FIG. 1 and select output from the comparators B-CB1~CB16 at the timing to match the 127 slots of t2 time slots. The multiplexers M1~M16 outputs 16 lines of 1-bit data as head data (DATA1~DATA15) through the 16 lines of data lines DATA1~DATA16, but only 15 data lines are used in this case.

Accordingly, data strings such as those shown in (1)~(8) in FIG. 1 are output to respective heating elements to correspond with the required gradation levels through each data line DATA1~DATA15.

Figure 4:
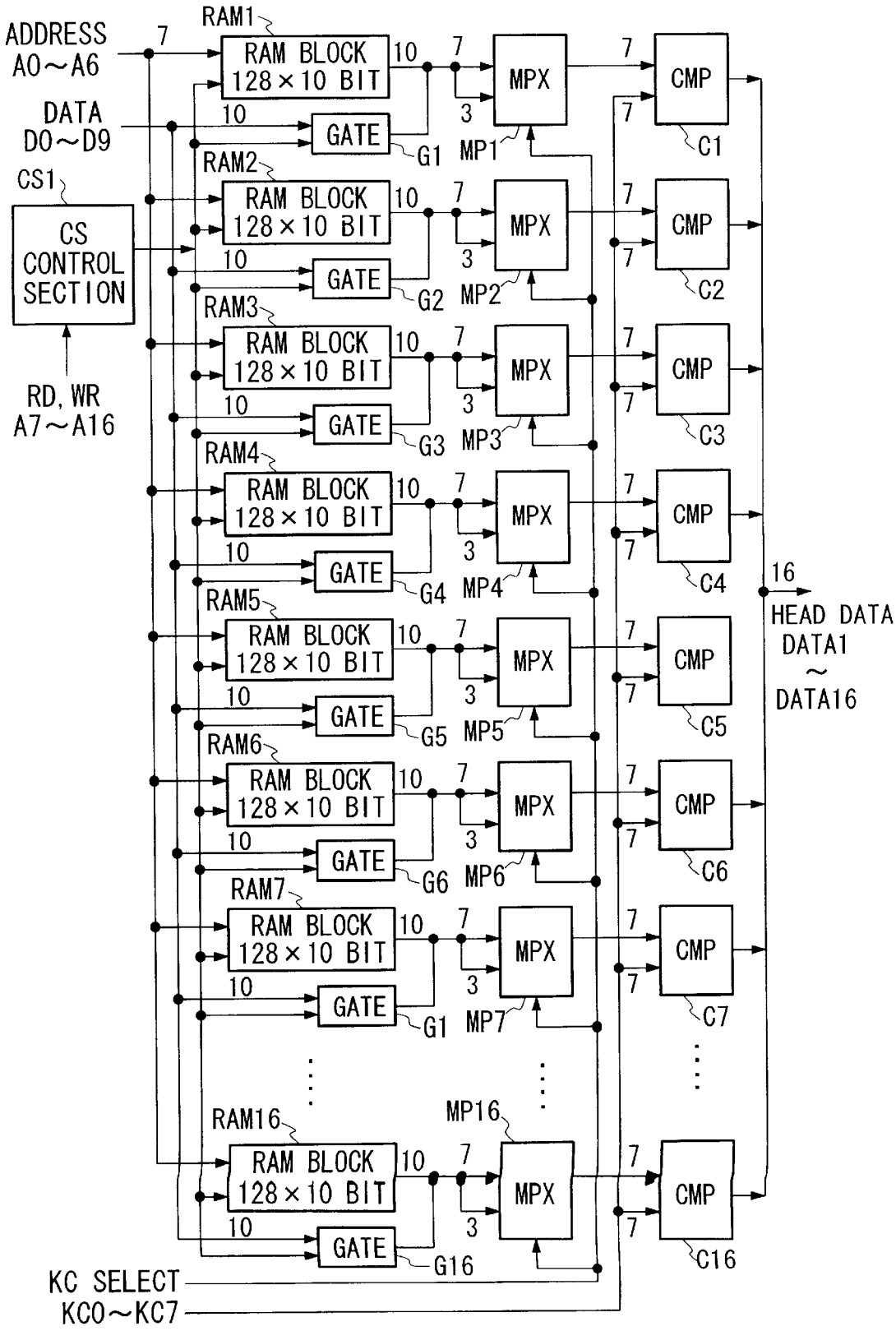
FIG. 4 is a block diagram of another example of the control device for the thermal head.

FIG. 4 shows another configuration of the control circuit for operating the present thermal head control device. This control device is comprised by: 16-blocks of random-access-memories RAM1~RAM16, each having a memory section to store 128 data of 10-bit data; 16-units of multiplexers MP1~MP16 for dividing the 10-bit data output from the RAM blocks RAM1~RAM16 into upper 7-bits and lower 3-bits, receiving them in two selection terminals, selecting one of the input data and outputting as 7-bit data; and 16-units of comparators C1~C16 for comparing 7-bit reference signals KC0~KC7, supplied from the central processing device and others, with output from the multiplexers MP1~MP16, and outputting the results.

The control device shown in FIG. 4 is further provided with a chip selection (CS) control circuit CS1 for supplying control signals such as chip selection signals and others to the input terminals of the RAM blocks RAM1~RAM16, and to connect or block on-off control signals to the 16-gates of the gating circuits G1~G16 to control supply of 10-bit gradation data D0~D9 to data input terminals of RAM blocks RAM1~RAM16, according to read signals RD, write signals WD, address signals A7~A16, which are forwarded from the central processing device and others.

The control device having the circuit configuration described above shown in FIG. 4, temporarily stores 10-bit gradation data for each heating element in a memory region having a specific memory address, in each of the RAM blocks RAM1~RAM16 to be selected by the values 0~127 of the address signals A0~A6 supplied from the central processing device, and generates data signals DATA1~DATA15 to be input into the thermal head shown in FIG. 5 according to the stored data, and outputs the control-data at a specific timing. Selection signals KC SELECT and comparison reference signals KC0~KC7 to be supplied to the 16-units of multiplexers MP1~MP16 are supplied from the central processing device at a given timing, but it is obvious that methods for generating such timing signal and operation of the components in the device are the same as those of the control device explained by referring to FIG. 3, and therefore, detailed explanations are not repeated.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A control device for controlling a thermal printing head having a plurality of heating elements to correspond to a plurality of imprinting dots and a plurality of registers for holding individual 1-bit signals to drive respective heating elements, comprising:

dividing means for dividing data of multi-level gradation produced by each imprinting dot into a plurality of different weighted values according to gradation values; and pulse signal generation means for generating a plurality of pulse signals having pre-determined pulse widths according to weighting of respective gradation values to be expressed so as to produce a number of pulses or pulse widths in accordance with a plurality of values of divided gradation data.

2. A control device according to claim 1, wherein said data of multi-level gradation are comprised by a plurality of bits, and said dividing means are comprising a temporary memory means for temporary storage of said data of multi-level gradation, and comparison means for dividing temporary stored data of multi-level gradation into a specific number of upper bits and lower bits and comparing with a given reference value that increases or decreases successively.

3. A control device according to claim 1, wherein said pulse width according to weighted gradation values is adjustable by varying an overall pulse width, a heat-on interval and a heat-off interval within said overall pulse width according to a pattern of temperature rise in said thermal printing head.

4. A control device according to claim 2, wherein said pulse width according to weighted gradation values is adjustable by varying an overall pulse width, a heat-on interval and a heat-off interval within said overall pulse width according to a pattern of temperature rise in said thermal printing head.

5. A printing apparatus comprising a plurality of heating elements to correspond to a plurality of imprinting dots, a plurality of 1-bit registers for holding signals for driving respective heating elements, and a control device for a thermal printing head according to claim 1.

6. A printing apparatus comprising a plurality of heating elements to correspond to a plurality of imprinting dots, a plurality of 1-bit registers for holding signals for driving respective heating elements, and a control device for a thermal printing head according to claim 2.

7. A printing apparatus comprising a plurality of heating elements to correspond to a plurality of imprinting dots, a plurality of 1-bit registers for holding signals for driving respective heating elements, and a control device for a thermal printing head according to claim 3.

8. A printing apparatus comprising a plurality of heating elements to correspond to a plurality of imprinting dots, a plurality of 1-bit registers for holding signals for driving individual heating elements, and a control device for a thermal printing head according to claim 4.

9. A control device for controlling a thermal printing head having a plurality of heating elements to correspond to a plurality of imprinting dots and a plurality of registers for holding individual 1-bit signals to drive respective heating elements, comprising:

dividing means for dividing data of multi-level gradation produced by each imprinting dot into a plurality of different weighted values according to gradation values; and pulse signal generation means for generating a plurality of pulse signals having pre-determined pulse widths according to weighting of respective gradation values to be expressed so as to produce a number of pulses or pulse widths in accordance with a plurality of values of divided gradation data of multi-level gradation, wherein pulse-on duration and pulse-off duration for impressing pulse signals during the pre-determined pulse widths are adjusted so that the temperature rise of the thermal printing head for one gradation level will be a constant value.

* * * * *